US007275566B2

(12) United States Patent
Ward

(10) Patent No.: US 7,275,566 B2
(45) Date of Patent: Oct. 2, 2007

(54) WARPED STITCHED PAPERMAKER'S FORMING FABRIC WITH FEWER EFFECTIVE TOP MD YARNS THAN BOTTOM MD YARNS

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 62 days.

(21) Appl. No.: 11/362,959

(22) Filed: Feb. 27, 2006

(65) Prior Publication Data

US 2007/0199609 A1 Aug. 30, 2007

(51) Int. Cl.
*D21F 7/08* (2006.01)
*D03D 25/00* (2006.01)

(52) U.S. Cl. ..... 139/383 A; 162/358.2

(58) Field of Classification Search ..... 139/383 A, 139/383 AA; 162/358.2
See application file for complete search history.

(56) References Cited

U.S. PATENT DOCUMENTS

| | | | |
|---|---|---|---|
| 2,172,430 | A | 9/1939 | Barrell |
| 2,554,034 | A | 5/1951 | Koester et al. |
| 3,094,149 | A | 6/1963 | Keily |
| 3,325,909 | A | 6/1967 | Clark |
| 4,093,512 | A | 6/1978 | Fleischer |
| 4,182,381 | A | 1/1980 | Gisbourne |

(Continued)

FOREIGN PATENT DOCUMENTS

DE 454 092 12/1927

(Continued)

OTHER PUBLICATIONS

International Search Report for PCT/US2004/008311.

(Continued)

*Primary Examiner*—Gary L. Welch
*Assistant Examiner*—Robert H Muromoto, Jr.
(74) *Attorney, Agent, or Firm*—Myers Bigel Sibley & Sajovec

(57) ABSTRACT

A papermaking fabric includes a series of repeat units, each of the repeat units including: a set of top machine direction (MD) yarns; a set of top cross machine direction (CMD) yarns interwoven with the top MD yarns; a set of bottom MD yarns; a set of bottom CMD yarns interwoven with the bottom MD yarns; and a set of stitching yarns. The stitching yarns are disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns, such that each stitching yarn pair forms a composite top MD yarn. The set of top MD yarns includes a first number of top MD yarns, the set of stitching yarns comprises a second number of composite top MD yarns, and the set of bottom MD yarns includes a third number of bottom MD yarns. The ratio of the sum of the first and second numbers to the third number is 2:3.

22 Claims, 9 Drawing Sheets

U.S. PATENT DOCUMENTS

| | | | | | |
|---|---|---|---|---|---|
| 4,244,543 | A | | 1/1981 | Ericson | |
| 4,289,173 | A | | 9/1981 | Miller | |
| 4,290,209 | A | | 9/1981 | Buchanan et al. | |
| 4,414,263 | A | | 11/1983 | Miller et al. | |
| 4,438,788 | A | | 3/1984 | Harwood | |
| 4,452,284 | A | | 6/1984 | Eckstein et al. | |
| 4,453,573 | A | | 6/1984 | Thompson | |
| 4,501,303 | A | | 2/1985 | Osterberg | |
| 4,515,853 | A | | 5/1985 | Borel | |
| 4,529,013 | A | | 7/1985 | Miller | |
| 4,564,052 | A | | 1/1986 | Borel | |
| 4,564,551 | A | | 1/1986 | Best | |
| 4,592,395 | A | | 6/1986 | Borel | |
| 4,592,396 | A | | 6/1986 | Borel et al. | |
| 4,605,585 | A | | 8/1986 | Johansson | |
| 4,611,639 | A | | 9/1986 | Bugge | |
| 4,621,663 | A | | 11/1986 | Malmendier | |
| 4,633,596 | A | | 1/1987 | Josef | |
| 4,636,426 | A | | 1/1987 | Fleischer | |
| 4,642,261 | A | | 2/1987 | Fearnhead | |
| 4,676,278 | A | | 6/1987 | Dutt | |
| 4,705,601 | A | | 11/1987 | Chiu | |
| 4,709,732 | A | | 12/1987 | Kinnunen | |
| 4,729,412 | A | | 3/1988 | Bugge | |
| 4,731,281 | A | | 3/1988 | Fleischer et al. | |
| 4,739,803 | A | | 4/1988 | Borel | |
| 4,755,420 | A | | 7/1988 | Baker et al. | |
| 4,759,975 | A | | 7/1988 | Sutherland et al. | |
| 4,815,499 | A | | 3/1989 | Johnson | |
| 4,815,503 | A | | 3/1989 | Borel | |
| 4,909,284 | A | | 3/1990 | Kositzke | |
| RE33,195 | E | | 4/1990 | McDonald et al. | |
| 4,934,414 | A | | 6/1990 | Borel | |
| 4,941,514 | A | | 7/1990 | Taipale | |
| 4,942,077 | A | | 7/1990 | Wendt et al. | |
| 4,945,952 | A | * | 8/1990 | Vohringer | 139/383 A |
| 4,967,805 | A | | 11/1990 | Chiu et al. | |
| 4,987,929 | A | * | 1/1991 | Wilson | 139/383 A |
| 4,989,647 | A | | 2/1991 | Marchand | |
| 4,989,648 | A | * | 2/1991 | Tate et al. | 139/383 A |
| 4,998,568 | A | | 3/1991 | Vohringer | |
| 4,998,569 | A | | 3/1991 | Tate | |
| 5,022,441 | A | | 6/1991 | Tate et al. | |
| 5,025,839 | A | | 6/1991 | Wright | |
| 5,067,526 | A | | 11/1991 | Herring | |
| 5,074,339 | A | * | 12/1991 | Vohringer | 139/383 A |
| 5,084,326 | A | | 1/1992 | Vohringer | |
| 5,092,372 | A | * | 3/1992 | Fitzka et al. | 139/383 A |
| 5,101,866 | A | | 4/1992 | Quigley | |
| 5,116,478 | A | * | 5/1992 | Tate et al. | 162/358.2 |
| 5,152,326 | A | | 10/1992 | Vohringer | |
| 5,158,118 | A | | 10/1992 | Tate et al. | |
| 5,219,004 | A | * | 6/1993 | Chiu | 139/383 A |
| 5,228,482 | A | | 7/1993 | Fleischer | |
| 5,277,967 | A | | 1/1994 | Zehle et al. | |
| 5,358,014 | A | * | 10/1994 | Kovar | 139/383 A |
| 5,421,374 | A | | 6/1995 | Wright | |
| 5,421,375 | A | | 6/1995 | Praetzel | |
| 5,429,686 | A | | 7/1995 | Chiu et al. | |
| 5,437,315 | A | * | 8/1995 | Ward | 139/383 A |
| 5,449,026 | A | | 9/1995 | Lee | |
| 5,454,405 | A | * | 10/1995 | Hawes | 139/383 A |
| 5,456,293 | A | | 10/1995 | Ostermayer et al. | |
| 5,465,764 | A | | 11/1995 | Eschmann et al. | |
| 5,482,567 | A | | 1/1996 | Barreto | |
| 5,487,414 | A | | 1/1996 | Kuji et al. | |
| 5,518,042 | A | | 5/1996 | Wilson | |
| 5,520,225 | A | | 5/1996 | Quigley et al. | |
| 5,542,455 | A | | 8/1996 | Ostermayer et al. | |
| 5,555,917 | A | | 9/1996 | Quigley | |
| 5,564,475 | A | | 10/1996 | Wright | |
| 5,641,001 | A | | 6/1997 | Wilson | |
| 5,651,394 | A | | 7/1997 | Marchand | |
| 5,709,250 | A | * | 1/1998 | Ward et al. | 139/383 A |
| RE35,777 | E | | 4/1998 | Givin | |
| 5,746,257 | A | | 5/1998 | Fry | |
| 5,826,627 | A | | 10/1998 | Seabrook et al. | |
| 5,857,498 | A | | 1/1999 | Barreto et al. | |
| 5,881,764 | A | | 3/1999 | Ward | |
| 5,894,867 | A | | 4/1999 | Ward et al. | |
| 5,899,240 | A | | 5/1999 | Wilson | |
| 5,937,914 | A | | 8/1999 | Wilson | |
| 5,967,195 | A | | 10/1999 | Ward | |
| 5,983,953 | A | * | 11/1999 | Wilson | 139/383 A |
| 6,073,661 | A | | 6/2000 | Wilson | |
| 6,112,774 | A | | 9/2000 | Wilson | |
| 6,123,116 | A | * | 9/2000 | Ward et al. | 139/383 A |
| 6,145,550 | A | | 11/2000 | Ward | |
| 6,148,869 | A | | 11/2000 | Quigley | |
| 6,158,478 | A | | 12/2000 | Lee et al. | |
| 6,179,965 | B1 | | 1/2001 | Cunnane et al. | |
| 6,202,705 | B1 | | 3/2001 | Johnson et al. | |
| 6,207,598 | B1 | | 3/2001 | Lee et al. | |
| 6,227,255 | B1 | | 5/2001 | Osterberg et al. | |
| 6,237,644 | B1 | | 5/2001 | Hay et al. | |
| 6,240,973 | B1 | | 6/2001 | Stone et al. | |
| 6,244,306 | B1 | | 6/2001 | Troughton | |
| 6,253,796 | B1 | | 7/2001 | Wilson et al. | |
| 6,276,402 | B1 | | 8/2001 | Herring | |
| 6,379,506 | B1 | | 4/2002 | Wilson et al. | |
| 6,581,645 | B1 | | 6/2003 | Johnson et al. | |
| 6,585,006 | B1 | | 7/2003 | Wilson et al. | |
| 6,837,277 | B2 | * | 1/2005 | Troughton et al. | 139/383 A |
| 6,899,143 | B2 | * | 5/2005 | Rougvie et al. | 139/383 A |
| 7,001,489 | B2 | | 2/2006 | Taipale et al. | |
| 7,059,357 | B2 | * | 6/2006 | Ward | 139/348 |
| 7,108,020 | B2 | * | 9/2006 | Stone | 139/383 A |
| 2003/0010393 | A1 | | 1/2003 | Kuji | |
| 2004/0079434 | A1 | | 4/2004 | Martin et al. | |
| 2004/0102118 | A1 | | 5/2004 | Hay et al. | |

FOREIGN PATENT DOCUMENTS

| | | | |
|---|---|---|---|
| DE | 3318980 | A1 | 11/1984 |
| DE | 33 29 740 | A1 | 3/1986 |
| EP | 0 048 962 | B2 | 9/1981 |
| EP | 0 158 710 | A1 | 10/1984 |
| EP | 0 185 177 | B1 | 10/1985 |
| EP | 0 224 276 | B1 | 12/1986 |
| EP | 0 264 881 | B1 | 10/1987 |
| EP | 0 269 070 | B1 | 11/1987 |
| EP | 0 284 575 | B1 | 2/1988 |
| EP | 0 283 181 | B1 | 3/1988 |
| EP | 0 350 673 | B1 | 6/1989 |
| EP | 0 408 849 | A2 | 5/1990 |
| EP | 0 408 849 | A3 | 5/1990 |
| EP | 0 672 782 | B1 | 3/1995 |
| EP | 0 794 283 | A1 | 9/1997 |
| EP | 0 794 283 | B1 | 9/1997 |
| FR | 2 597 123 | A1 | 4/1986 |
| GB | 2 157 328 | A | 10/1985 |
| GB | 2 245 006 | A | 2/1991 |
| JP | 8-158285 | | 12/1994 |
| WO | WO86/00099 | | 1/1986 |
| WO | WO89/09848 | | 4/1989 |
| WO | WO 03/10304 | A2 | 11/1992 |
| WO | WO99/61698 | | 5/1999 |
| WO | WO 02/00996 | A2 | 1/2002 |
| WO | WO 03/093573 | A1 | 11/2003 |

OTHER PUBLICATIONS

International Search Report for PCT Application No. PCT/US97/18629.

Rule 132 Declaration of Robert G. Wilson (Jun. 26, 1997).

Warren, C.A., "The Importance of Yarn Properties in West-End Wire Construction," Seminar, The Theory of Water Removal, Dec. 12, 1979.

European Search Report corresponding to application No. EP 05002306.8, dated Oct. 18, 2005.

* cited by examiner 31 32 33 34 35 36 37 38 39 40 41 42 43 44 45 46
51
71 72 73 74 75 76 77 78

31 33 35 37 39 41 43 45
11

71 75
52

34 36 38 40
21
77

53
73 77

22
32 73 42 44 46

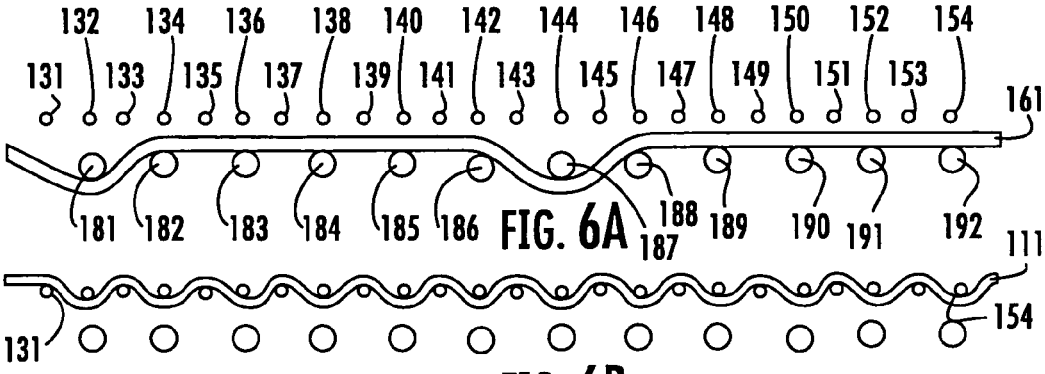
FIG. 6A
FIG. 6B
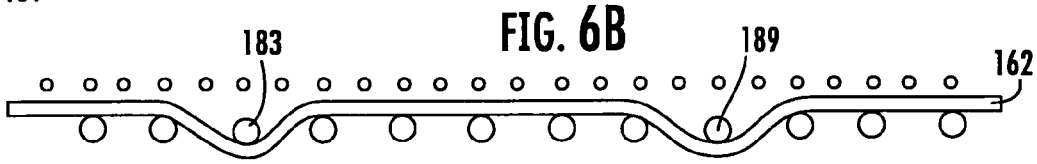
FIG. 6C
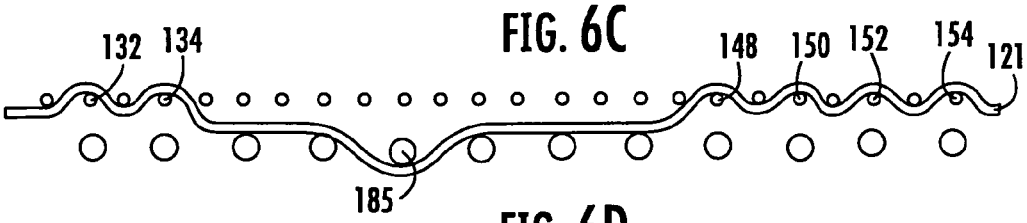
FIG. 6D
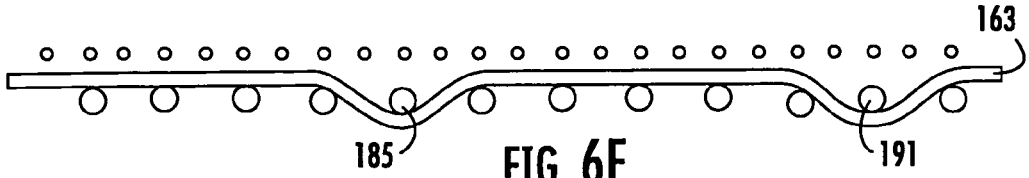
FIG. 6E
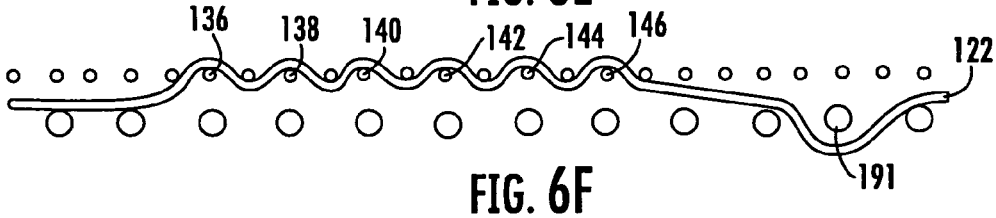
FIG. 6F

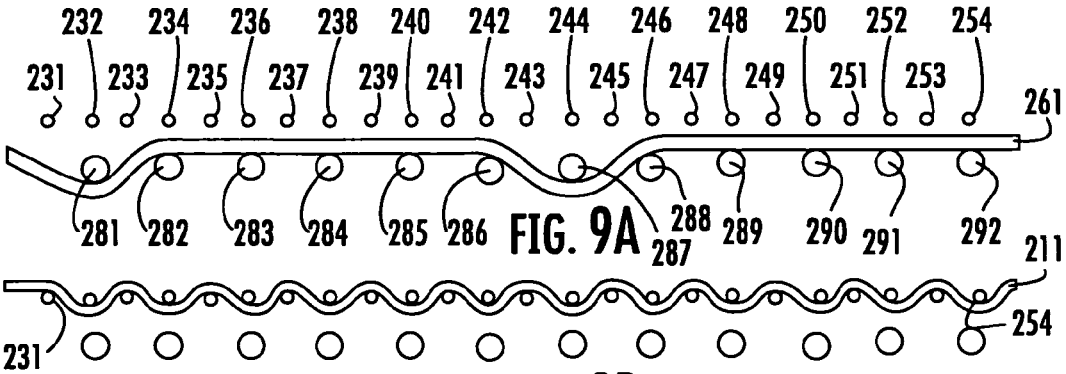
FIG. 9A
FIG. 9B
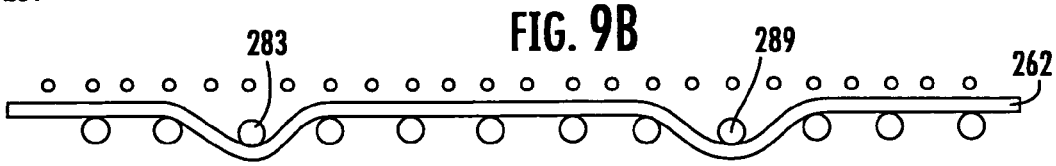
FIG. 9C
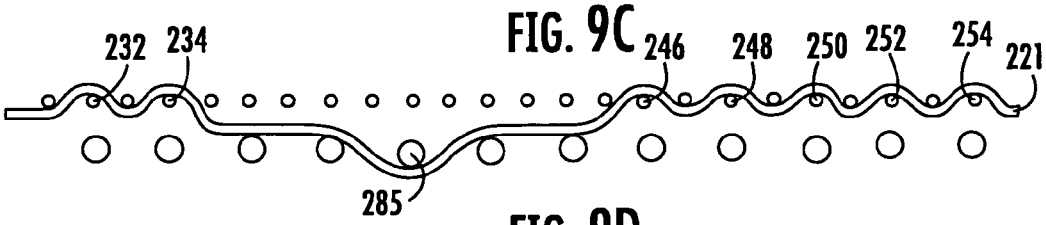
FIG. 9D
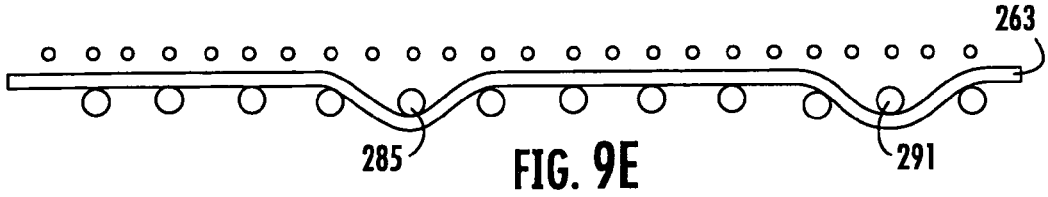
FIG. 9E
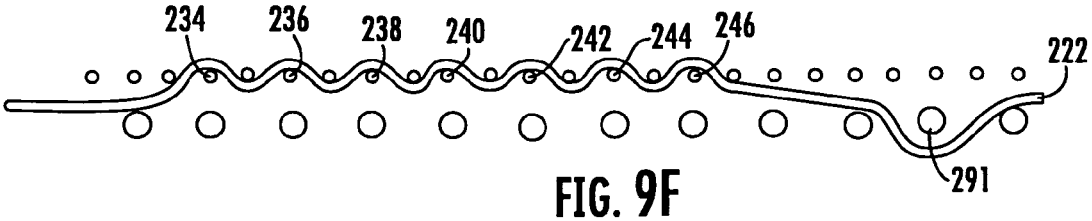
FIG. 9F

WARPED STITCHED PAPERMAKER'S FORMING FABRIC WITH FEWER EFFECTIVE TOP MD YARNS THAN BOTTOM MD YARNS

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

U.S. Pat. No. 6,896,009 and co-pending and co-assigned U.S. patent application Ser. No. 11/207,277, filed Aug. 18, 2005 describe a number of exemplary multi-layer forming fabrics that are "warped-stitched." In some instances such fabrics may be easier to manufacture than weft-stitched forming fabrics and/or may have desirable performance properties. However, there is still a demand for additional types of warp-stitched fabrics to meet the vast array of papermaking needs.

SUMMARY OF THE INVENTION

As a first aspect, embodiments of the present invention are directed to a papermaking fabric comprising a series of repeat units. Each of the repeat units includes: a set of top machine direction (MD) yarns; a set of top cross machine direction (CMD) yarns interwoven with the top MD yarns; a set of bottom MD yarns; a set of bottom CMD yarns interwoven with the bottom MD yarns; and a set of stitching yarns. The stitching yarns are disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns, such that each stitching yarn pair forms a composite top MD yarn. The set of top MD yarns includes a first number of top MD yarns, the set of stitching yarns comprises a second number of composite top MD yarns, and the set of bottom MD yarns includes a third number of bottom MD yarns. The ratio of the sum of the first and second numbers to the third number is 2:3. A fabric of this structure can have performance advantages, including higher top surface open area, higher top CMD yarn support, improved drainage capacity, and good stability and surface topography.

As a second aspect, embodiments of the present invention are directed to a papermaking fabric comprising a series of repeat units, wherein each of the repeat units includes: a set of top MD yarns; a set of top cross machine direction CMD yarns interwoven with the top MD yarns; a set of bottom MD yarns; a set of bottom CMD yarns interwoven with the bottom MD yarns; and a set of stitching yarns. The stitching yarns are disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns. The set of top MD yarns includes a first number of top MD yarns, the set of stitching yarns comprises a second number of stitching yarn pairs, and the set of bottom MD yarns includes a third number of bottom MD yarns. The ratio of the sum of the first and second numbers to the third number is 2:3. The same performance advantages mentioned above can also be achieved with such a fabric.

As a third aspect, embodiments of the present invention are directed to a papermaking fabric comprising a series of repeat units, each of the repeat units including: a set of top MD yarns; a set of top CMD yarns interwoven with the top MD yarns; a set of bottom MD yarns; a set of bottom CMD yarns interwoven with the bottom MD yarns; and a set of stitching yarns. The stitching yarns are disposed in pairs, at least one of the yarns of each of the stitching yarn pairs being interwoven with the top CMD yarns and the bottom CMD yarns. When a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns, such that each stitching yarn pair forms a composite top MD yarn. The set of top MD yarns includes a first number of top MD yarns, the set of stitching yarns comprises a second number of composite top MD yarns, and the set of bottom MD yarns includes a third number of bottom MD yarns. The sum of the first and second numbers is less than the third number.

As a fourth aspect, embodiments of the present invention are directed to a papermaking fabric comprising a series of repeat units, each of the repeat units including: a set of top MD yarns; a set of top CMD yarns interwoven with the top MD yarns; a set of bottom MD yarns; a set of bottom CMD yarns interwoven with the bottom MD yarns; and a set of stitching yarns, the stitching yarns being disposed in pairs, and at least one of the yarns of each of the stitching yarn pairs is interwoven with the top CMD yarns and the bottom CMD yarns. When a first portion of a first stitching yarn of a pair is interweaving with the top CMD yarns, a first portion of second stitching yarn of the pair is passing below the top CMD yarns, and when a second portion of the second stitching yarn of the pair is interweaving with the top CMD yarns, a second portion of the first stitching yarn of the pair is passing below the top CMD yarns, such that each stitching yarn pair forms a composite top MD yarn. The first portion of the first stitching yarn and the second portion of the second stitching yarn pass above a common top CMD yarn. A fabric of this configuration can exhibit improved top surface topography.

As a fourth aspect, embodiments of the present invention are directed to a method of making paper, comprising the steps of: (a) providing a papermaking fabric of the type described above; (b) applying paper stock to the fabric; and (c) removing moisture from the paper stock.

BRIEF DESCRIPTION OF THE FIGURES

FIGS. 6A-6F are section views taken of exemplary machine direction yarns of the fabric of FIGS. 4 and 5.

FIGS. 9A-9F are section views taken of exemplary machine direction yarns of the fabric of FIGS. 7 and 8.

DETAILED DESCRIPTION OF EMBODIMENTS OF THE INVENTION

Figure 1:
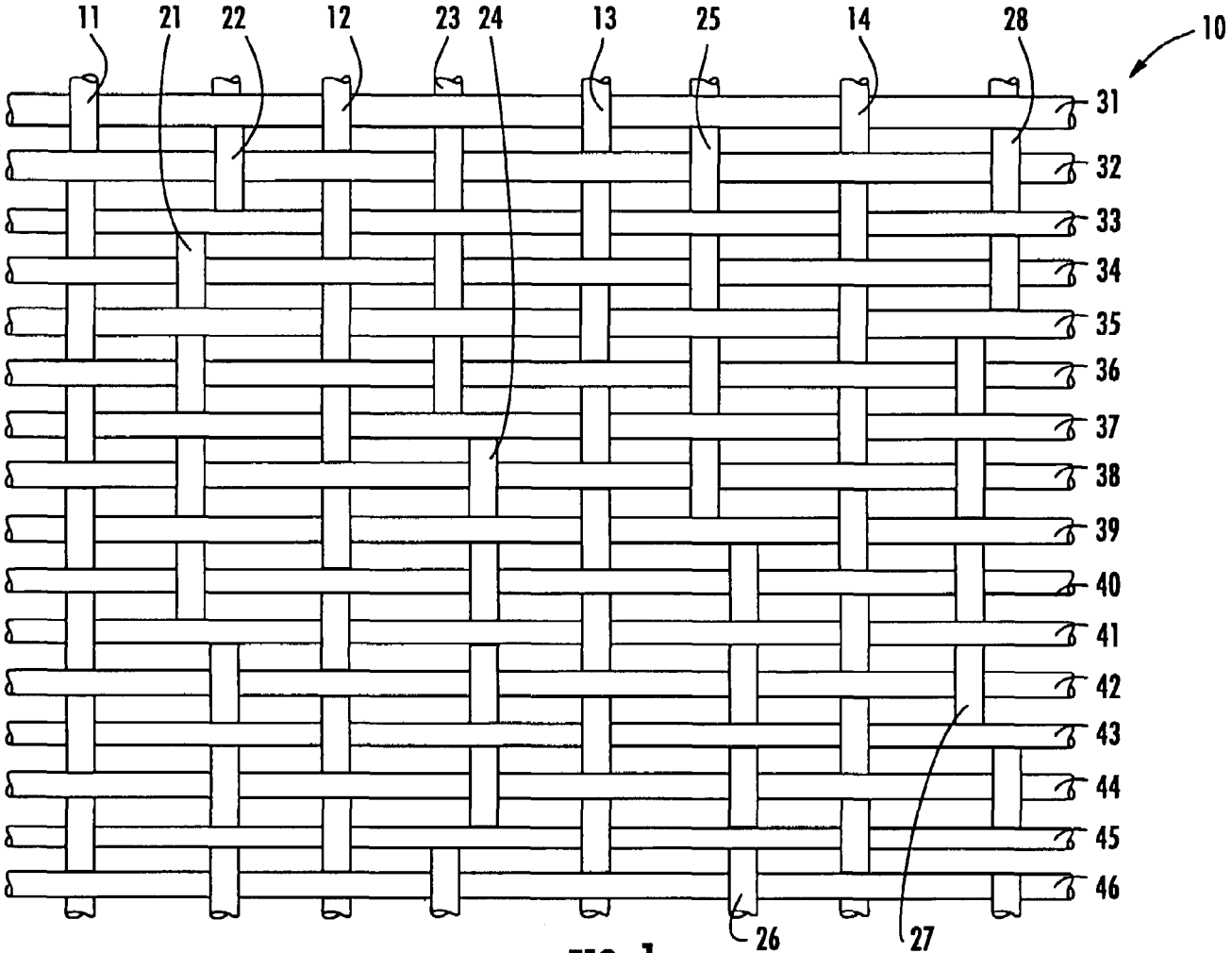
FIG. 1 is a top view of a repeat unit of a forming fabric according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Although the figures below only show single repeat units of the fabrics illustrated therein, those of skill in the art will appreciate that in commercial applications the repeat units shown in the figures would be repeated many times, in both the machine and cross machine directions, to form a large fabric suitable for use on a papermaking machine.

Referring now to the figures, a fabric, designated broadly at 10, is illustrated in FIG. 1. Turning now to FIGS. 1-3F, a repeat unit of a forming fabric according to embodiments of the present invention, designated broadly at 10, is illustrated therein. The repeat unit 10 includes four top MD yarns 11-14, four pairs of MD stitching yarns 21-28, sixteen top CMD yarns 31-46, twelve bottom MD yarns 51-62, and eight bottom CMD yarns 71-78. The interweaving of these yarns is described below.

Figures 3A, 3B, 3C, 3D, 3E, 3F:
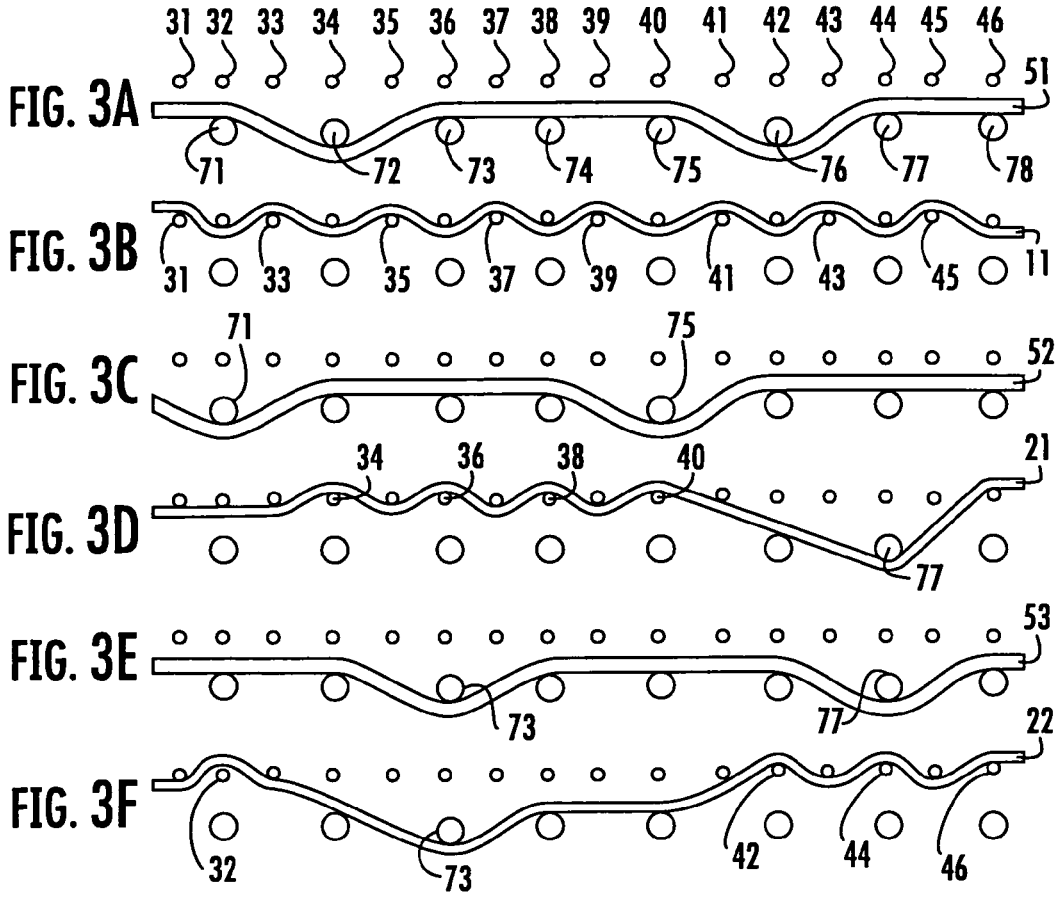
FIGS. 3A-3F are section views taken of exemplary machine direction yarns of the fabric of FIGS. 1 and 2.

As can be seen in FIGS. 1 and 3B, each of the top MD yarns 11-14 interweaves with the top CMD yarns 31-46 in an "over 1/under 1" sequence, in which the top MD yarns 11-14 pass over the odd-numbered top CMD yarns 31, 33, 35, 37, 39, 41, 43, 45 and under the even-numbered top CMD yarns 32, 34, 36, 38, 40, 42, 44, 46 (see, e.g., top MD yarn 11 in FIG. 3B). As can be seen in FIG. 1, each pair of stitching yarns 21-28 is located between two top MD yarns. As can be seen in FIGS. 1, 3D and 3F, each of the stitching yarn pairs 21-28 combines to act as a single "composite" yarn in completing the plain weave pattern on the top surface of the fabric 10. More specifically, each of the stitching yarns passes over four even-numbered top CMD yarns, with the stitching yarns designated with an odd number (e.g., stitching yarn 21 or 23) passing over one set of four even-numbered top CMD yarns, and each of the stitching yarns designated with an even number (e.g., stitching yarn 22 or 24) passing over a set of the remaining four even-numbered top CMD yarns. For example, stitching yarn 21 passes over top CMD yarns 34, 36, 38 and 40 while passing below top CMD yarns 33, 35, 37, 39 and 41, and stitching yarn 22 passes over top CMD yarns 42, 44, 46 and 32 while passing below top CMD yarns 41, 43, 45, 31 and 33. Thus, together stitching yarns 21, 22 form a "composite" top MD yarn that follows an overall "over 1/under 1" path relative to the top CMD yarns. Because each of the "composite" top MD yarn thusly formed passes over even-numbered top CMD yarns, a plain weave pattern is formed with the top MD yarns 11-14 and the top CMD yarns 31-46 on the top, or papermaking, surface of the fabric 10.

Each pair of stitching yarns is offset from its neighboring stitching yarn pairs. In the illustrated embodiment, the stitching yarn pair 21, 22 is offset from the adjacent pair 23, 24 by twelve top CMD yarns, the pair 23, 24 is offset from the adjacent pair 25, 26 by two top CMD yarns, and the pair 25, 26 is offset from the adjacent pair 27, 28 by four top CMD yarns.

Figure 2:
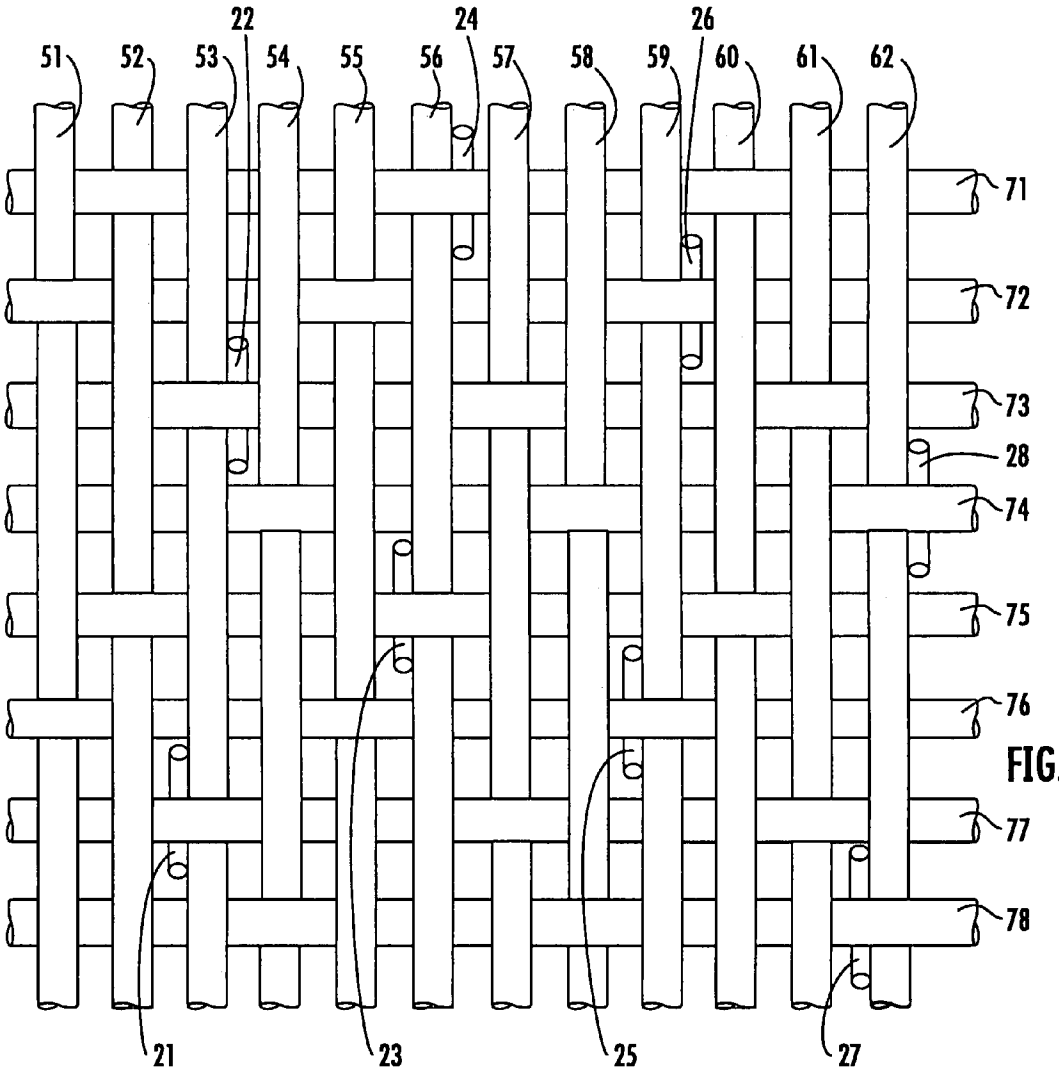
FIG. 2 is a top view of the bottom layer of the repeat unit of the fabric of FIG. 1.

The bottom layer of the fabric 10 is illustrated in FIG. 2. The bottom layer includes twelve bottom MD yarns 51-62, the stitching yarns 21-28 and eight bottom CMD yarns 71-78. The bottom MD yarns interweave with the bottom CMD yarns in an "over 3/under 1" sequence. For example, referring to FIGS. 2 and 3C, bottom MD yarn 52 passes under bottom CMD yarn 71, over bottom CMD yarns 72-74, under bottom CMD yarn 75, and over bottom CMD yarns 76-78. Each bottom MD yarn is offset from its adjacent bottom MD yarns such that a four-harness satin pattern is formed by the knuckles of the bottom MD yarns on the bottom surface of the fabric 10.

Referring again to FIG. 2, each pair of stitching yarns 21-28 sandwiches a bottom MD yarn (e.g., stitching yarns 21-22 sandwich bottom MD yarn 53), and each stitching yarn forms one knuckle under a bottom CMD yarn. As used herein, "knuckle" refers to a portion of one yarn that, in interweaving with other yarns, passes above or below a single other yarn, whereas a "float" refers to a portion of one yarn that passes above or below multiple adjacent yarns. Each knuckle formed by a stitching yarn is positioned beside a knuckle formed by the immediately adjacent bottom MD yarn, such that each stitching yarn pair and their sandwiched bottom MD yarns form pairs of knuckles. For example, bottom MD yarn 53 forms knuckles below bottom CMD yarns 73 and 77 (see FIG. 3E). Stitching yarn 21 forms a knuckle under bottom CMD yarn 77 (FIG. 3D), and stitching yarn 22 forms a knuckle under bottom CMD yarn 73 (FIG. 3F). Thus, each stitching yarn 21-28 is offset from the other stitching yarn of the pair by four bottom CMD yarns. Each pair of stitching yarns is offset from its neighboring stitching yarn pairs consistent with the offset for a four harness satin pattern on the bottom surface of the fabric.

It can be seen that, in the illustrated repeat unit of the fabric 10, there are twelve bottom MD yarns and, effectively, eight top MD yarns (i.e., four conventional and four "composite" top MD yarns formed by the four stitching yarn pairs). The inclusion of more bottom MD yarns than effective top MD yarns can increase top surface open area and fiber support by top CMD yarns. The inclusion of MD stitching yarns can increase permeability, improve seam strength, and reduce interlayer wear, as well as simplify manufacturing by reducing the number of CMD yarns (which are typically woven as weft yarns) and reducing the number of yarns for joining at a seam.

It can also be seen that the ratio of effective top MD yarns (i.e., the sum of number of top MD yarns and the number of stitching yarn pairs) to bottom MD yarns in the illustrated fabric is 2:3. It has been discovered that a 2:3 top MD yarn/bottom MD yarn ratio can provide significant performance advantages to a forming fabric. For example, the length of CMD knuckles on the top layer can be increased compared to typical plain weave fabrics, which can provide a higher drainage capacity relative to fabrics with a ratio of 1:1, and typically has greater stability and better stability than weft-stitched fabrics with a 1:2 ratio, particularly with lower mesh counts also employed in the fabric. In addition, fewer top MD yarns can enable a larger yarn to be employed in certain embodiments of the fabric; a larger yarn can provide improved shower resistance and top surface wear resistance.

A typical fabric with a four harness bottom layer according to embodiments of the present invention may have the characteristics set forth in Table 1.

TABLE 1

| Yarn Type | Size (mm) |
|---|---|
| Top MD | 0.14 |
| Bottom MD | 0.17 |
| Stitching Yarns | 0.13 |
| Top CMD | 0.13 |
| Bottom CMD | 0.25 |
| Mesh | |
| (top, epcm* × ppcm**) | 25 × 40 |
| (total) | 75 × 60 |

*ends per centimeter
**picks per centimeter

A repeat unit of another fabric according to embodiments of the present invention is designated broadly at 110 and is shown in FIGS. 4-6F. The repeat unit 110 includes four top MD yarns 111-114, four pairs of MD stitching yarns 121-128, twenty-four top CMD yarns 131-154, twelve bottom MD yarns 161-176, and twelve bottom CMD yarns 181-192. The interweaving of these yarns is described below.

Figure 4:
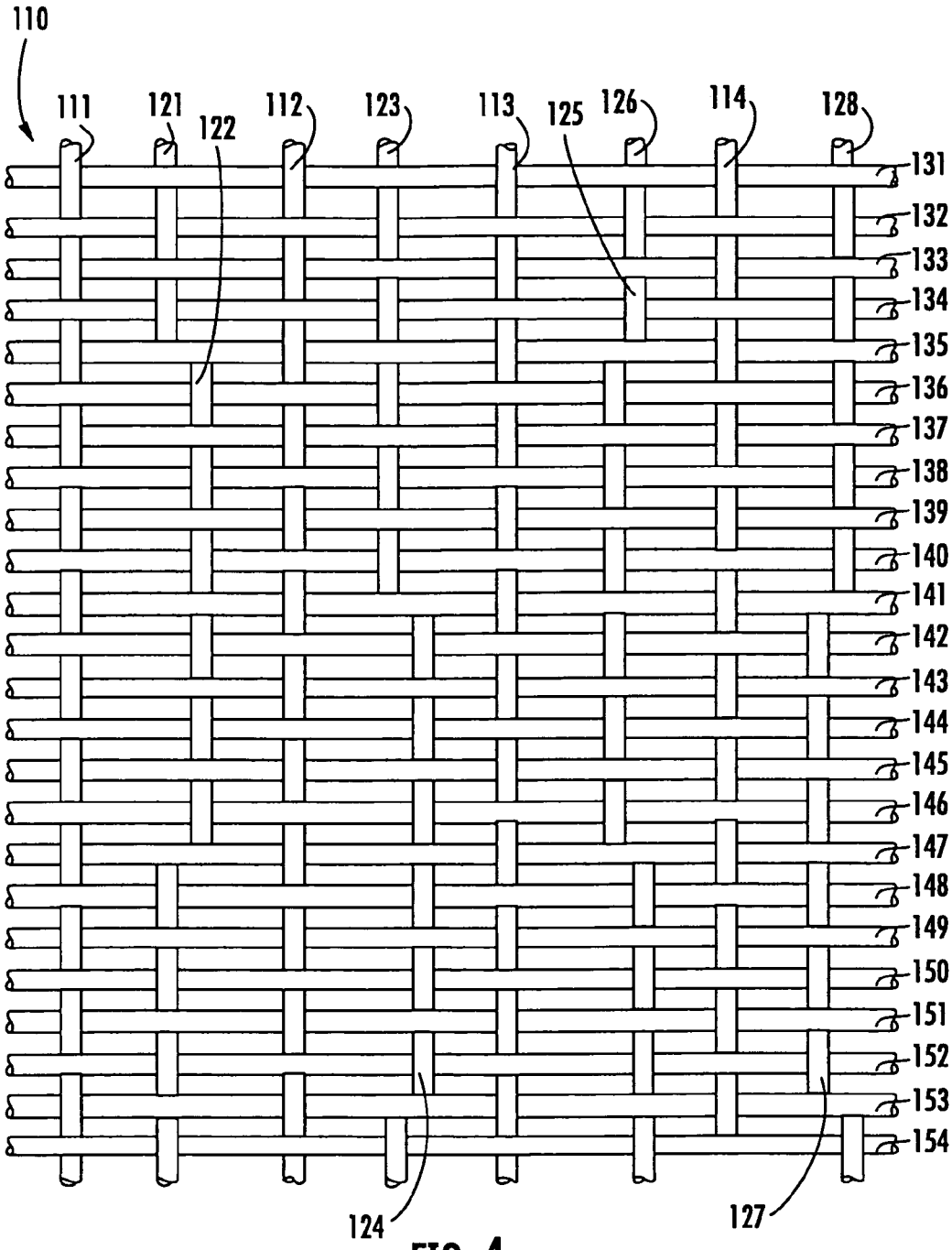
FIG. 4 is a top view of a repeat unit of a forming fabric according to other embodiments of the present invention.

As can be seen in FIGS. 4 and 6B, each of the top MD yarns 111-114 interweaves with the top CMD yarns 131-154 in an "over 1/under 1" sequence, in which the top MD yarns 111-114 pass over the odd-numbered top CMD yarns 131, 133, 135, 137, 139, 141, 143, 145, 147, 149, 151, 153 and under the even-numbered top CMD yarns 132, 134, 136, 138, 140, 142, 144, 146, 148, 150, 152, 154. As can be seen in FIG. 4, each pair of stitching yarns 121-128 is located between two top MD yarns. As can be seen in FIGS. 4, 6D and 6F, each of the stitching yarn pairs 121-128 combines to act as a single yarn in completing the plain weave pattern on the top surface of the fabric 110 (similar to that shown above in FIGS. 1-3F for the repeat unit 10). More specifically, each of the stitching yarns passes over six even-numbered top CMD yarns, with the stitching yarns designated with an odd number (e.g., stitching yarn 121 or 123) passing over one set of six even-numbered top CMD yarns, and each of the stitching yarns designated with an even number (e.g., stitching yarn 122 or 124) passing over a set of the remaining six even-numbered top CMD yarns. For example, stitching yarn 121 passes over top CMD yarns 148, 150, 152, 154, 132 and 134 while passing below top CMD yarns 147, 149, 151, 153, 131, 133 and 135, and stitching yarn 122 passes over top CMD yarns 136, 138, 140, 142, 144 and 146 while passing below top CMD yarns 135, 137, 139, 141, 143, 145 and 147. Thus, in the manner described above with respect to the repeat unit 10, together stitching yarns 121, 122 form a "composite" top MD yarn that follows an overall "over 1/under 1" path relative to the top CMD yarns. The "composite" top MD yarn thusly formed passes over even-numbered top CMD yarns, thereby forming a plain weave pattern with the top MD yarns 111-114 and the top CMD yarns 131-154 on the top, or papermaking, surface of the fabric 110.

Each pair of stitching yarns is offset from its neighboring stitching yarn pairs by six top CMD yarns. As an example, both of the yarns of the stitching yarn pair 121, 122 pass below top CMD yarn 135. Both yarns of the adjacent stitching yarn pair 123, 124 pass below top CMD yarn 141, which is offset from top CMD yarn 135 by six top CMD yarns. This offset is repeated throughout the repeat unit 110 (see FIG. 4).

Figure 5:
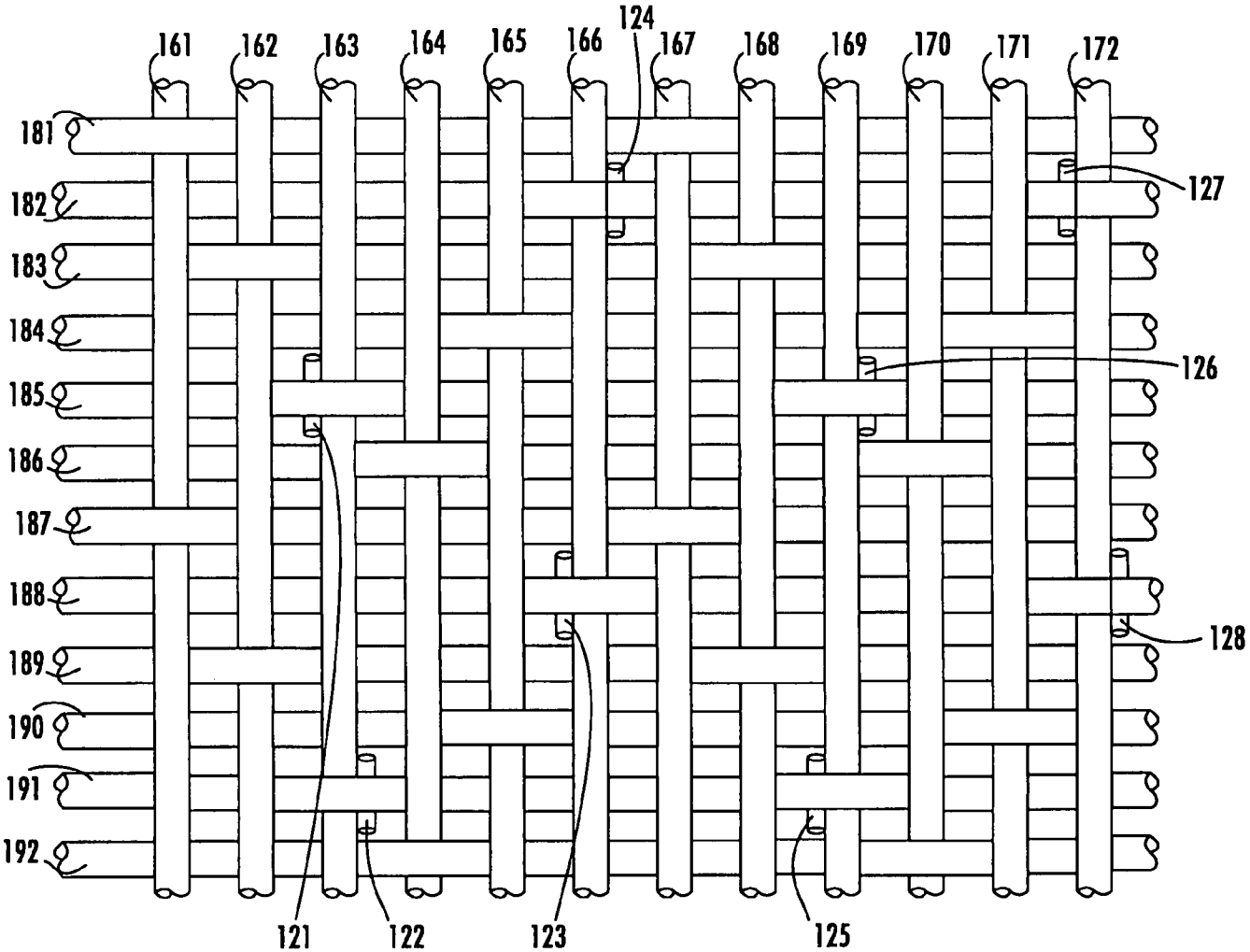
FIG. 5 is a top view of the bottom layer of the repeat unit of the fabric of FIG. 4.

The bottom layer of the fabric 110 is illustrated in FIG. 5. The bottom layer includes twelve bottom MD yarns 161-172, the stitching yarns 121-128 and twelve bottom CMD yarns 181-192. The bottom MD yarns interweave with the bottom CMD yarns in an "over 5/under 1" sequence. For example, referring to FIGS. 5 and 6A, bottom MD yarn 161 passes under bottom CMD yarn 181, over bottom CMD yarns 182-186, under bottom CMD yarn 187, and over bottom CMD yarns 188-192. Each bottom MD yarn is offset from its adjacent bottom MD yarns such that the MD knuckles of the bottom MD yarns form a six harness broken twill pattern.

Referring again to FIG. 5, each pair of stitching yarns 121-128 sandwiches a bottom MD yarn (e.g., stitching yarns 121-122 sandwich bottom MD yarn 163), and each stitching yarn forms one knuckle under a bottom CMD yarn. As with the fabric illustrated in FIGS. 1-3F, each knuckle formed by a stitching yarn is positioned beside a knuckle formed by the immediately adjacent bottom MD yarn, such that each stitching yarn pair and their sandwiched bottom MD yarns form pairs of knuckles. For example, bottom MD yarn 163 forms knuckles below bottom CMD yarns 185 and 191 (see FIG. 6E). Stitching yarn 121 forms a knuckle under bottom CMD yarn 185 (FIG. 6D), and stitching yarn 122 forms a knuckle under bottom CMD yarn 191 (FIG. 6F). Thus, each stitching yarn 121-128 is offset from the other stitching yarn of the pair by six bottom CMD yarns. Each pair of stitching yarns is offset from its neighboring stitching yarn pairs by three bottom CMD yarns, which is consistent with the six top CMD yarn offset discussed above in connection with the top surface of the repeat unit 110.

Like the repeat unit 10, the repeat unit 110 has a 2:3 ratio of effective top MD yarns/bottom MD yarns. As such, it can provide some, if not all, of the advantages noted above in connection with the repeat unit 10. The yarn sizes of one embodiment of a fabric having the structure illustrated in FIGS. 4-6F are listed in Table 2.

TABLE 2

| Yarn Type | Size (mm) |
|---|---|
| Top MD | 0.14 |
| Bottom MD | 0.17 |
| Stitching Yarns | 0.13 |
| Top CMD | 0.13 |
| Bottom CMD | 0.25 |
| Mesh | |
| (top, epcm × ppcm) | 25 × 40 |
| (total) | 75 × 60 |

A repeat unit of an additional fabric according to embodiments of the present invention is designated broadly at 210 and is shown in FIGS. 7-9F. The repeat unit 210 includes four top MD yarns 211-214, four pairs of MD stitching yarns 221-228, twenty-four top CMD yarns 231-254, twelve bottom MD yarns 261-276, and twelve bottom CMD yarns 281-292. The interweaving of these yarns is described below.

Figure 7:
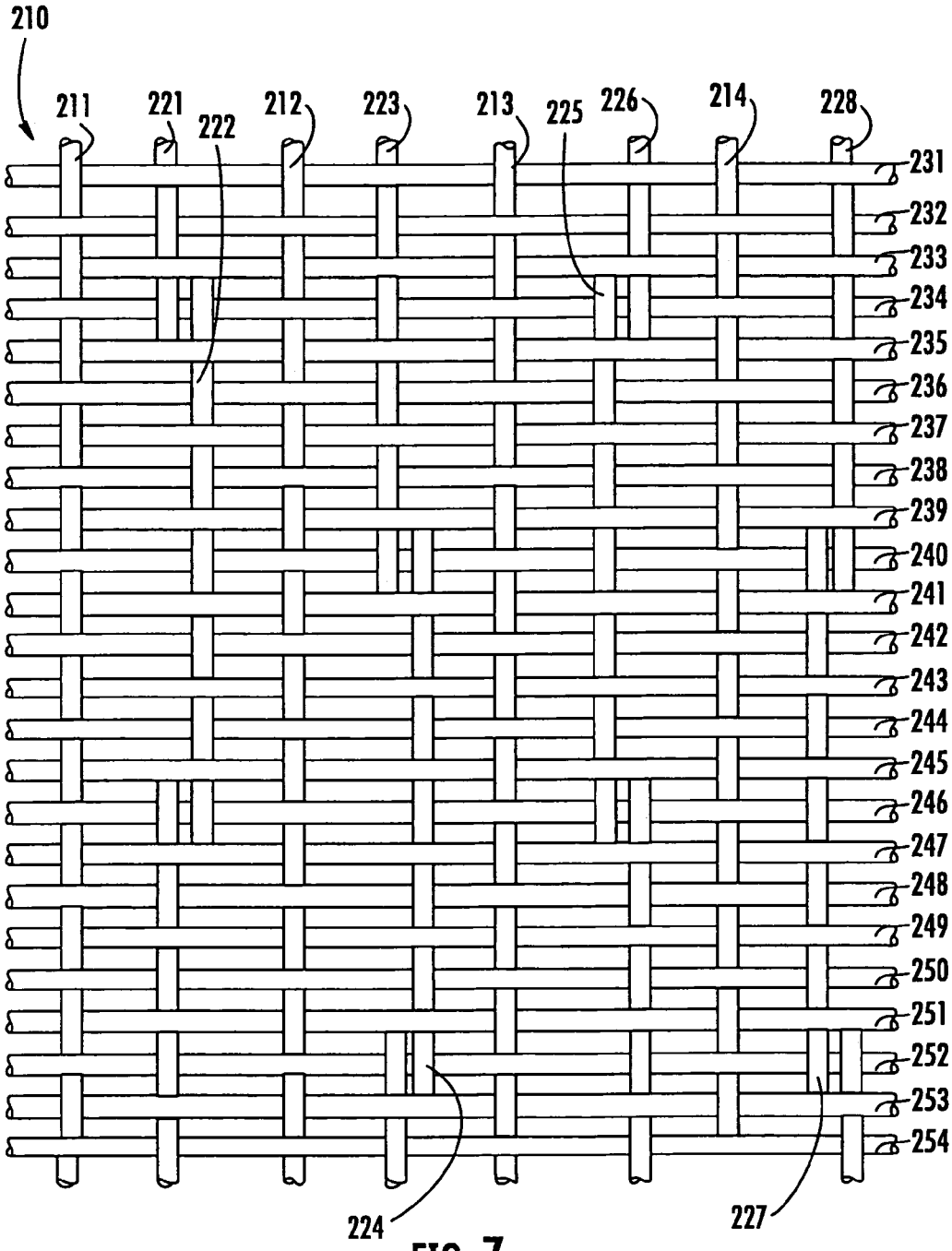
FIG. 7 is a top view of a repeat unit of a forming fabric according to other embodiments of the present invention.

As can be seen in FIGS. 7 and 9B, each of the top MD yarns 211-214 interweaves with the top CMD yarns 231-254 in an "over 1/under 1" sequence, in which the top MD yarns 211-214 pass over the odd-numbered top CMD yarns 231, 233, 235, 237, 239, 241, 243, 245, 247, 249, 251, 253 and under the even-numbered top CMD yarns 232, 234, 236, 238, 240, 242, 244, 246, 248, 250, 252, 254. As can be seen in FIG. 7, each pair of stitching yarns 221-228 is located between two top MD yarns. As can be seen in FIGS. 7, 9D and 9F, each of the stitching yarn pairs 221-228 combines to act as a single yarn in completing the plain weave pattern on the top surface of the fabric 210 (similar to that shown above in FIGS. 1-3F for the repeat unit 10 and FIGS. 4-6F for the repeat unit 110). However, each of the stitching yarn pairs has two stitching points at which both of the stitching yarns of the pair pass above the same top CMD yarn. Thus, each of the stitching yarns passes over seven even-numbered top CMD yarns, with the stitching yarns designated with an odd number (e.g., stitching yarn 221 or 223) passing over one set of seven even-numbered top CMD yarns, and each of the stitching yarns designated with an even number (e.g., stitching yarn 222 or 224) passing over a set of the remaining five even-numbered top CMD yarns plus the top CMD yarns that are positioned at either end of the first set of top CMD yarns. For example, stitching yarn 221 passes over top CMD yarns 246, 248, 250, 252, 254, 232 and 234 while passing below top CMD yarns 245, 247, 249, 251, 253, 231, 233 and 235, and stitching yarn 222 passes over top CMD yarns 234, 236, 238, 240, 242, 244 and 246 while passing below top CMD yarns 233, 235, 237, 239, 241, 243, 245 and 247. Thus, together the stitching yarns 221, 222 form a "composite" top MD yarn that follows an overall "over 1/under 1" path relative to the top CMD yarns with the exception of the top CMD yarns 234 and 246, which both of the stitching yarn pairs pass over (as used herein, the term "composite yarn" is intended to include both the stitching yarn pairs of FIGS. 1-6F, in which the stitching yarns do not form top surface knuckles over the same top CMD yarn, and the stitching yarn pairs of FIGS. 7-9F, in which the "ends" of the stitching yarns pass over the same top MCD yarn). The "composite" top MD yarn thusly formed passes over even-numbered top CMD yarns, thereby forming a plain weave pattern with the top MD yarns 211-214 and the top CMD yarns 231-254 on the top, or papermaking, surface of the fabric 210 (as used herein, a "plain weave pattern" is intended to encompass both the complete "over 1/under 1" pattern of the fabrics of FIGS. 1-6F and the "over 1/under 1" pattern of the fabric of FIGS. 7-9F that varies from a conventional plain weave due to the additional top surface knuckles positioned at either end of the stitching yarns).

Each pair of stitching yarns is offset from its neighboring stitching yarn pairs by six top CMD yarns. As an example, both of the yarns of the stitching yarn pair 221, 222 pass above top CMD yarn 234. Both yarns of the adjacent stitching yarn pair 223, 224 pass above top CMD yarn 240, which is offset from top CMD yarn 234 by six top CMD yarns. This offset is repeated throughout the repeat unit 210 (see FIG. 7).

Figure 8:
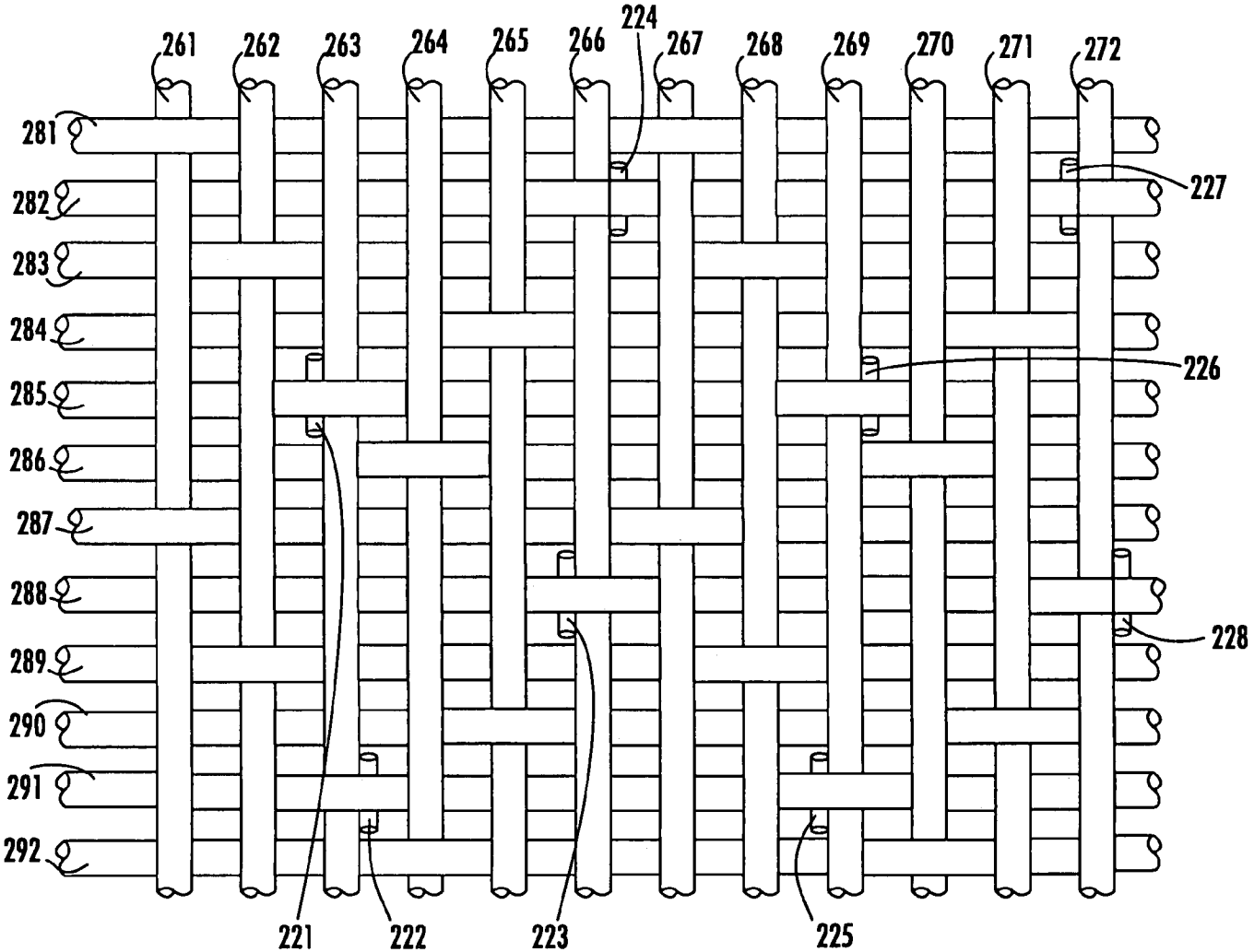
FIG. 8 is a top view of the bottom layer of the repeat unit of the fabric of FIG. 7.

The bottom layer of the fabric 210 is illustrated in FIG. 8. The bottom layer includes twelve bottom MD yarns 261-272, the stitching yarns 221-228 and twelve bottom CMD yarns 281-292. The bottom MD yarns interweave with the bottom CMD yarns in an "over 5/under 1" sequence. For example, referring to FIGS. 8 and 9A, bottom MD yarn 261 passes under bottom CMD yarn 281, over bottom CMD yarns 282-286, under bottom CMD yarn 287, and over bottom CMD yarns 288-292. Each bottom MD yarn is offset from its adjacent bottom MD yarns such that the MD knuckles of the bottom MD yarns form a six harness broken twill pattern.

Referring again to FIG. 8, each pair of stitching yarns 221-228 sandwiches a bottom MD yarn (e.g., stitching yarns 221-222 sandwich bottom MD yarn 263), and each stitching yarn forms one knuckle under a bottom CMD yarn. As with the fabrics illustrated in FIGS. 1-3F and 4-6F, each knuckle formed by a stitching yarn is positioned beside a knuckle formed by the immediately adjacent bottom MD yarn, such that each stitching yarn pair and their sandwiched bottom MD yarns form pairs of knuckles. For example, bottom MD yarn 263 forms knuckles below bottom CMD yarns 285 and 291 (see FIG. 9E). Stitching yarn 221 forms a knuckle under bottom CMD yarn 285 (FIG. 9D), and stitching yarn 222 forms a knuckle under bottom CMD yarn 291 (FIG. 9F). Thus, each stitching yarn 221-228 is offset from the other stitching yarn of the pair by six bottom CMD yarns. Each pair of stitching yarns is offset from its neighboring stitching yarn pairs by three bottom CMD yarns, which is consistent with the six top CMD yarn offset discussed above in connection with the top surface of the repeat unit 210.

Like the repeat units 10 and 110, the repeat unit 210 has a 2:3 ratio of effective top MD yarns/bottom MD yarns. As such, it can provide some, if not all, of the advantages noted above in connection with the repeat unit 10. The yarn sizes of one embodiment of a fabric having the structure illustrated in FIGS. 7-9F are listed in Table 3.

TABLE 3

| Yarn Type | Size (mm) |
|---|---|
| Top MD | 0.14 |
| Bottom MD | 0.17 |
| Stitching Yarns | 0.13 |
| Top CMD | 0.13 |
| Bottom CMD | 0.25 |
| Mesh | |
| (top, epcm × ppcm) | 25 × 40 |
| (total) | 75 × 60 |

This fabric can be effective in improving the surface topography of the fabric. In some instances, a top CMD yarn under which both stitching yarns of a pair pass under (such as top CMD yarn 234, under which both stitching yarns 221 and 222 pass) may be positioned slightly lower on the top surface of the fabric due to the lack of support from the stitching yarns. The "double knuckles" formed by both stitching yarns of a pair (for example, both stitching yarns 221, 222 pass over top CMD yarn 234) pass above can address this issue by raising the elevation of these knuckles. This can improve surface topography of the top surface of the fabric 210.

Those skilled in this art will appreciate that fabrics of the present invention may take different forms. For example, different numbers of top and bottom machine direction yarns per repeat unit may be employed to satisfy the desirable 2:3 top MD yarn/bottom MD yarn ratio (e.g., four top MD yarns and six bottom yarns, or 16 top MD yarns and 24 bottom MD yarns). As another example, different numbers of stitching yarn pairs per top MD yarn may be used (e.g., there may be one stitching yarn pair for every two or three top MD yarns, or alternatively two or three stitching yarn pairs for every top MD yarn). As a further example, the number of top and/or bottom CMD yarns may vary. Also, the stitching yarns of a pair may interweave with different numbers of top CMD yarns, or one stitching yarn of the pair may only interweave with the top CMD yarns (see, e.g., International Patent Publication No. WO 2004/085741, the disclosure of which is hereby incorporated herein in its entirety). Moreover, the top surface of the fabric need not be a plain weave as illustrated, but may be satin, twill or the like, and the bottom surface of the fabric need not be a satin weave, but may take another form, such as a plain weave or twill. Other variations of weave patterns may also be employed with fabrics of the present invention.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide may be suitable.

Although exemplary yarn sizes are set forth above for the fabrics of FIGS. 1-9F, those skilled in this art will appreciate that yarns of different sizes may be employed in fabric embodiments of the present invention. For example, the top MD yarns, top CMD yarns, and stitching yarns may have a diameter of between about 0.10 and 0.20 mm, the bottom MD yarns may have a diameter of between about 0.15 and 0.25 mm, and the bottom CMD yarns may have a diameter of between about 0.20 and 0.30 mm. The mesh of fabrics according to embodiments of the present invention may also vary. For example, the mesh of the top surface may vary between about 20×30 to 30×50 (epcm to ppcm), and the total mesh may vary between about 60×45 to 90×75.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A papermaking fabric, comprising a series of repeat units, each of the repeat units including:

a set of top machine direction (MD) yarns;

a set of top cross machine direction (CMD) yarns interwoven with the top MD yarns;

a set of bottom MD yarns;

a set of bottom CMD yarns interwoven with the bottom MD yarns; and a set of stitching yarns, the stitching yarns being disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns, such that each stitching yarn pair forms a composite top MD yarn;

wherein the set of top MD yarns includes a first number of top MD yarns, and wherein the set of stitching yarns comprises a second number of composite top MD yarns, and wherein the set of bottom MD yarns includes a third number of bottom MD yarns; and wherein the ratio of the sum of the first and second numbers to the third number is 2:3.

2. The papermaking fabric defined in claim 1, wherein one of the set of stitching yarn pairs is positioned between each adjacent pair of top MD yarns.

3. The papermaking fabric defined in claim 1, wherein a first yarn of each of the stitching yarn pairs stitches on one side of a bottom MD yarn, and a second yarn of each of the stitching yarn pairs stitches on the other side of that bottom MD yarn.

4. The papermaking fabric defined in claim 1, wherein each of the stitching yarns of a pair passes below at least one bottom CMD yarn.

5. The papermaking fabric defined in claim 1, wherein the sum of the first and second numbers is eight.

6. The papermaking fabric defined in claim 1, wherein the diameters of the top MD yarns and the stitching yarns are substantially the same.

7. The papermaking fabric defined in claim 1, wherein the diameters of the top MD yarns and the stitching yarns are between about 0.10 and 0.20 mm.

8. The papermaking fabric defined in claim 1, wherein the top MD yarns, stitching yarns and top CMD yarns interweave with each other to form a plain weave pattern.

9. The papermaking fabric defined in claim 1, wherein the set of top CMD yarns comprises twice as many yarns as the set of bottom CMD yarns.

10. The papermaking fabric defined in claim 1, wherein the mesh of the top surface of the fabric is between about 20×30 and 30×50.

11. A papermaking fabric, comprising a series of repeat units, each of the repeat units including:

a set of top machine direction (MD) yarns;

a set of top cross machine direction (CMD) yarns interwoven with the top MD yarns;

a set of bottom MD yarns;

a set of bottom CMD yarns interwoven with the bottom MD yarns; and a set of stitching yarns, the stitching yarns being disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns;

wherein the set of top MD yarns includes a first number of top MD yarns, and wherein the set of stitching yarns comprises a second number of stitching yarn pairs, and wherein the set of bottom MD yarns includes a third number of bottom MD yarns; and wherein the ratio of the sum of the first and second numbers to the third number is 2:3.

12. The papermaking fabric defined in claim 11, wherein one of the set of stitching yarn pairs is positioned between each adjacent pair of top MD yarns.

13. The papermaking fabric defined in claim 11, wherein a first yarn of each of the stitching yarn pairs stitches on one side of a bottom MD yarn, and a second yarn of each of the stitching yarn pairs stitches on the other side of that bottom MD yarn.

14. The papermaking fabric defined in claim 11, wherein each of the stitching yarns of a pair passes below at least one bottom CMD yarn.

15. The papermaking fabric defined in claim 11, wherein the sum of the first and second numbers is eight.

16. The papermaking fabric defined in claim 11, wherein the diameters of the top MD yarns and the stitching yarns are substantially the same.

17. The papermaking fabric defined in claim 11, wherein the diameters of the top MD yarns and the stitching yarns are between about 0.10 and 0.20 mm.

18. The papermaking fabric defined in claim 11, wherein the top MD yarns, stitching yarns and top CMD yarns interweave with each other to form a plain weave pattern.

19. The papermaking fabric defined in claim 11, wherein the set of top CMD yarns comprises twice as many yarns as the set of bottom CMD yarns.

20. The papermaking fabric defined in claim 11, wherein the mesh of the top surface of the fabric is between about 20×30 and 30×50.

21. A papermaking fabric, comprising a series of repeat units, each of the repeat units including:

a set of top machine direction (MD) yarns;

a set of top cross machine direction (CMD) yarns interwoven with the top MD yarns;

a set of bottom MD yarns;

a set of bottom CMD yarns interwoven with the bottom MD yarns; and a set of stitching yarns, the stitching yarns being disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns, such that each stitching yarn pair forms a composite top MD yarn;

wherein the set of top MD yarns includes a first number of top MD yarns, and wherein the set of stitching yarns comprises a second number of composite top MD yarns, and wherein the set of bottom MD yarns includes a third number of bottom MD yarns; and wherein the sum of the first and second numbers is less than the third number.

22. A method of making paper, comprising the steps of:

(a) providing a papermaking fabric, the papermaking fabric including a series of repeat units, each of the repeat units comprising:

a set of top machine direction (MD) yarns;

a set of top cross machine direction (CMD) yarns interwoven with the top MD yarns;

a set of bottom MD yarns;

a set of bottom CMD yarns interwoven with the bottom MD yarns; and a set of stitching yarns, the stitching yarns being disposed in pairs, at least one of the yarns of each of the stitching yarn pairs being interwoven with the top CMD yarns and the bottom CMD yarns, wherein when a first stitching yarn of a pair is interweaving with the top CMD yarns, a second stitching yarn of the pair is passing below the top CMD yarns, and when the second stitching yarn of the pair is interweaving with the top CMD yarns, the first stitching yarn of the pair is passing below the top CMD yarns;

wherein the set of top MD yarns includes a first number of top MD yarns, and wherein the set of stitching yarns comprises a second number of stitching yarn pairs, and wherein the set of bottom MD yarns includes a third number of bottom MD yarns; and wherein the ratio of the sum of the first and second numbers to the third number is 2:3;

(b) applying paper stock to the papermaking fabric; and (c) removing moisture from the paper stock.

* * * * *